United States Patent [19]

Galea

[11] Patent Number: 4,742,916

[45] Date of Patent: May 10, 1988

[54] CORNER AND EDGE PROTECTORS FOR RECTANGULAR ARTICLES

[75] Inventor: Joseph Galea, Burlington, Canada

[73] Assignee: Kord Products Limited, Burlington, Canada

[21] Appl. No.: 59,327

[22] Filed: Jun. 8, 1987

[51] Int. Cl.[4] ..... B65D 81/06; B65D 85/30

[52] U.S. Cl. ..... 206/586; 217/53; 229/DIG. 1; 248/345.1

[58] Field of Search ..... 206/453, 586; 217/53; 229/DIG. 1, 2.5 R; 248/345.1

[56] References Cited

U.S. PATENT DOCUMENTS

| | | | |
|---|---|---|---|
| 2,266,181 | 12/1941 | Epps | 206/60 |
| 3,030,728 | 4/1962 | Wesman | 206/586 |
| 3,047,142 | 7/1962 | Heffley | 206/62 |
| 3,200,547 | 8/1965 | Johnson | 229/DIG. 1 |
| 3,762,626 | 10/1973 | Dorsey | 229/14 |
| 4,120,441 | 10/1978 | Hurley | 206/586 |
| 4,202,449 | 5/1980 | Bendt | 206/586 |
| 4,244,471 | 1/1981 | Plante | 206/586 |

*Primary Examiner*—Jimmy G. Foster

[57] ABSTRACT

Moulded fibre protectors for rectangular edges or corners of articles and having convergent ribbed and grooved walls contacting surfaces of the articles adjacent the edge or corner, the walls being joined by hollow ridges so that the walls of the article converge within channels inside the ridges, or within a convergence of the channels in the case of a corner protector, are improved by arranging the ribbing of the walls so that the hollow ridges adjacent the convergence of the walls are provided with maximum support by internal primary land portions on the protector walls which are uninterrupted by grooves formed on the inner surface of these walls. These primary land portions are divided from remaining land portions by primary grooves extending generally parallel to those edges of the protector walls remote from the convergence.

3 Claims, 2 Drawing Sheets

CORNER AND EDGE PROTECTORS FOR RECTANGULAR ARTICLES

This invention relates to ribbed protectors for the corners or edges of an object being shipped, such as an article of furniture or an appliance. Such protectors are commonly interposed between the object and an outer shipping container.

Examples of protectors of this type are disclosed in U.S. Pat. Nos. 2,266,181 (Epps), 3,047,142 (Heffley), 3,762,626 (Dorsey) and 4,120,441 (Hurley).

The Epps patents dicloses a unitary angle edge guard protector for interposition between a tie member and an exterior angle edge of an object to be shipped, having generally flat walls joined at a substantially 90° angle, the protector being formed on its outer surface with a number of recesses extending outwardly between ribs from a common ridge where the walls meet. The inner surface of the protector has inwardly directed flat faced ribs corresponding to the recesses, separated by grooves corresponding to the ribs, which grooves communicate with a common groove within the common ridge. The planes of the flat faced ribs intersect within this common groove.

The Hurley patent shows a very similar structure moulded from pulp, in which the walls in a free condition include an angle less than 90°, so that the protector will firmly grip a right angle edge to be protected when pressed onto the latter.

The Heffley patent shows a further rather similar structure, adapted to fit around the corner of a mirror, with a series of parallel internal grooves wrapping around the corner.

The Dorsey patent shows a corner protector, in which three walls are utilized, pairs of which present the same features as the Hurley patentso far as protection of the edges of an article adjacent a corner are concerned, except that the three walls have planes substantially normal to each other.

In the structures disclosed in each of these patents, the internal ribs and grooves in the walls of the protectors communicate with the ridge grooves or grooves and extend away from these ridge grooves or grooves. In moulded fibre structures, this can undesirably weaken the resistance of ridge portion or portions of the protectors, and of the corner protectors, to certain types of disruptive forces potentially damaging to an article being protected, particularly forces applied locally to the corner or edges of the protectors as opposed to the walls of the protectors.

The present invention seeks to meet this difficulty in a moulded pulp protector corner or edge by rearranging the rib and groove configuration utilized in the walls of the protector so as to provide adequate structural integrity of the walls without prejudicing the strength of the critical ridge portion (in the case of an edge protector) or apex portion (in the case of a corner protector), and to provide greater resistance of the walls to disruptive forces developed parallel to the ridge or circumferentially of the apex, such as may be engendered by a ridge or apex impact.

The invention relates to a protector for application to the external convergence of at least two perpendicular walls of an article to be shipped, of the above dicussed type which comprises unitarily moulded pulp walls equal in number to the number of walls of the article entering the convergence and having lands on their inner surfaces engageable with the walls of the article; the lands being located in planes having a convergence substantially coincident with said convergence of the article walls; the walls of the protector being substantially orthogonal and joined to each other by at least one internally concave and externally convex curved wall defining at least one channel within which planes of the lands of the protector walls intersect and within which the convergence occurs; and the walls being moulded to divide the lands into portions by a pattern of grooves on their inner surfaces corresponding to ridges on their outer surfaces such as to increase the effective thickness of the walls and increase their ability to protect the article from external forces and impacts.

According to the invention the pattern of grooves defined in each inner wall is separated from said convergence by a primary land portion on each inner wall which extends substantially continuously between the convergence and the pattern of grooves, which pattern includes a primary groove extending substantially parallel to that edge of the wall remote from the convergence.

In an edge protector, there are two walls of the article to be protected, the convergence is on a line extending along the channel between the two walls of the protector and the primary land portion extends between the channel and the primary groove of each wall. In a corner protector, there are three walls of the article to be protected, the convergence is at a point within a cavity defined at a junction of the channels between each pairing of the three walls of the protector, and the primary land portion of each wall extends between the primary groove and the junction of the channels. In each case, the portion of the protector defining the channel or channel junction containing the convergence is directly supported by the lands, thus maximizing the protection afforded to the edge or corner to be protected, and strengthening the walls of the protector immediately adjacent the edge or corner to be protected. This is in contrast to the prior art arrangements discussed, in which the grooves in the wall communicate with the channel or the junction of the channels adjacent the corner or edge, thus reducing support of the portion of the structure bridging the corner or edge in a critical zone adjacent the corner or edge.

Further features of the invention will become apparent from the following description of preferred embodiments with reference to the accompanying drawings.

IN THE DRAWINGS

DESCRIPTION OF THE PREFERRED EMBODIMENTS

Figure 1:
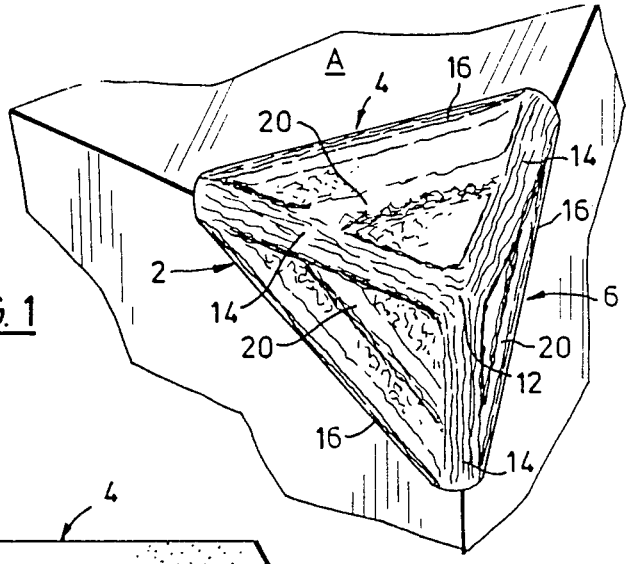
FIG. 1 is a perspective view of a corner protector in accordance with the invention, applied to a corner of a cuboid article to be protected.
Figure 2:
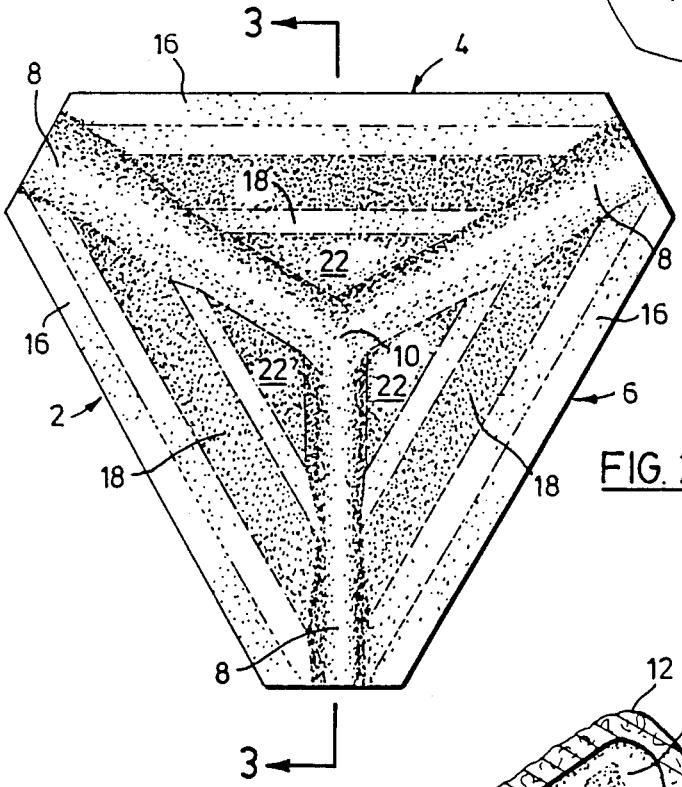
FIG. 2 is an inside plan view of the corner protector of FIG. 1.
Figure 3:
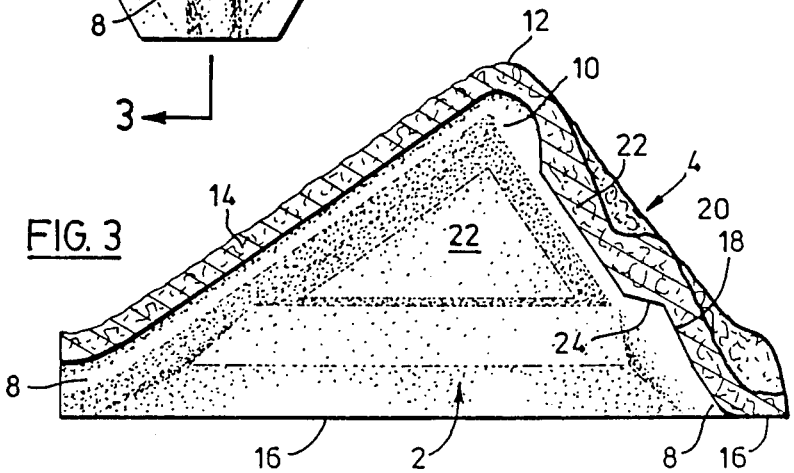
FIG. 3 is a section on the line 3—3 in FIG. 2.

Referring first the embodiment of FIGS. 1–3, the corner protector shown comprises three walls 2, 4 and 6 converging in three generally mutually perpendicular planes, the walls being formed from moulded pulp, typically by withdrawing water from the pulp through a porous mould having a shape complementary to the internal surface configuration of the protector. Techniques for manufacturing such pulp articles are well known and understood and need not be described. At the juncture of each adjacent pair of walls, a semicylindrical channel 8 is formed in the inside surface of the protector, these channels converging in a cavity 10 within the apex 12 of the protector. The channels 8 correspond to ridges 14 on the outer surface of the protector. Between the channels 8, the inside surfaces of the protector present generally flat triangular lands which engage surfaces of an article A to be protected adjacent a corner of the article. The corner of the article, and adjacent converging portions of the edges of the article, will be located respectively at a point within the cavity 10 and within the channels 8, out of contact with the protector. The article is thus held spaced from an outer container, such as a cardboard carton, within which the article is shipped. In order to maintain this spacing and afford further protection to the corner, the edges of the walls furthest from the apex are formed with out turned flanges 16. Further grooves are formed in the triangular lands, corresponding to ridges on the outer surface of the protector, so as to provides the walls 2, 4, 6 with a corrugated form. Contrary to the teaching of the Dorsey U.S. Pat. No. 3,762,626, I form primary grooves 18 parallel to those edges of the walls 2, 4, 6 remote from the apex 12 so as to form an A-frame rather than the trussed structure to which that patent refers. This arrangement provides the protection of an external ridge 20 across the exterior of each wall, without detracting from the support provided by a primary land portion 22 adjacent the cavity 10, and without weakening the flanges 16 or the critical portions of the channels 8 adjacent the apex, and without the mould complexities needed to produce the truss structure called for by the earlier patent. The grooves 18 can be of tapered angular cross section as seen in FIG. 3, providing a simple mould structure which presents no difficulty in separation from the moulding. The sides 24 of the grooves 18 which are nearest the apex provide localized reinforcement of the primary land portions 22, which provide the maximum support possible for the apex 12 since they are not interrupted by perpendicular grooves. The arrangement of the invention thus provides a satisfactory side wall structure without any compromise in the protection afforded to the corner of the article.

Figure 4:
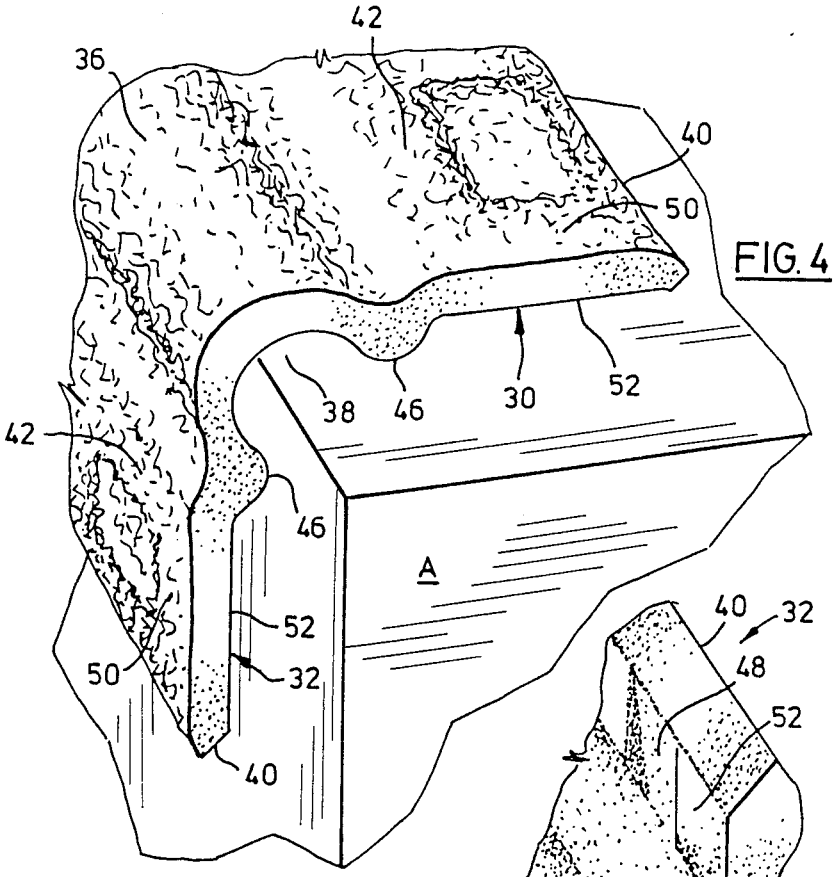
FIG. 4 is a perspective exterior view of a portion of an edge protector in accordance with the invention, applied to a rectangular edge to be protected.
Figure 5:
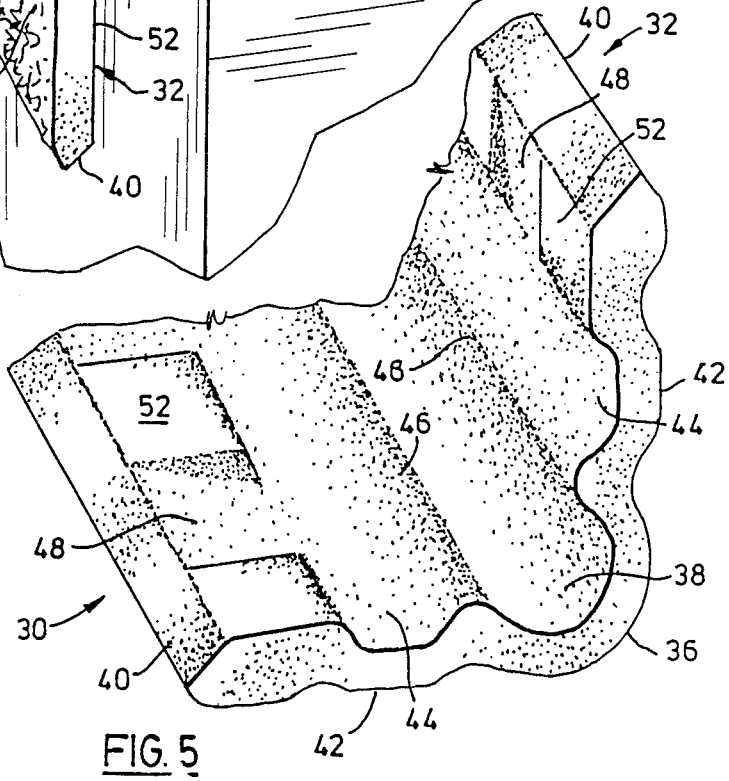
FIG. 5 is a perspective interior view of a portion of the edge protector of FIG. 4.

In the embodiment of FIGS. 4 and 5, an edge protector has two elongated rectangular walls 30 and 32 which converge substantially at a right angle. Whilst it is difficult to achieve angular precision in the moulding of such an item, the angle (assuming that a rectangular edge is to be protected) should not deviate significantly from a right angle since the protectors should be a snug fit between an article and its outer container and angle which deviates significantly from a right angle will make for difficulties in application. With a flimsy outer carton, the protector may moreover not rest snugly against the article, thus possibly reducing impact protection. The walls 32 and 34 are joined by a bulbous ridge 36 enclosing a channel 38, so that when the protector is applied to the rectangular edge of an article A to be protectored, the convergence of the walls of the article forming the actual edge lies on a line within the channel. In order to maintain spacing between an outer container and the article, and to provide further protection to the walls of the article A adjacent its edge, the walls 32 and 34 are formed with out-turned flanges 40 at their edges remote from the ridge 36, and with longitudinal ribs 42 on their outer surfaces corresponding to longitudinal primary grooves 44 on their inner surfaces, which extend parallel to the groove 38 and are separated from that groove on the inner surfaces by extended primary land portions 46 which provide substantially continuous support for the ridge 36 adjacent the channel 38, thus maximizing cushioning in this critical area of the unit. Additional internal indentations 48 corresponding to external ribs 50 may be formed in land portions 52 on the inner surface of the walls remoted from the ridges 36 so as to reinforce the marginal portions of the protector.

Since edge protectors may be formed in substantial lengths, it may be permissible to interrupt the land portions 46 at extended intervals, provided that substantial continuity of support for the ridge 36 is maintained. The land portion 46 should not however be interrupted by grooves at frequent intervals as in the Hurley U.S. Pat. No. 4,120,441, since the objective of the invention is to provide side walls providing adequate capability of supporting and maintaining spacing between the article and the walls of an outer container without in any way compromising the primary objective of protecting the edge of the article A.

I claim:

1. In a unitarily moulded pulp protector for application to the external convergence of at least two perpendicular walls of an article to be shipped, the protector comprising walls equal in number to the number of the walls of the article entering the convergence and having lands on their inner surfaces engageable with walls of the article, said lands being located in planes having a convergence substantially coincident with said convergence of the article walls, the walls of the protector being substantially orthogonal and joined to each other by at least one internally concave and externally converx curved wall defining at least one channel within which planes of the lands of the protector walls intersect and within which said convergence occurs, and the walls being moulded to divide said lands into portions by a pattern of grooves on their inner surfaces, corresponding to ridges on their outer surfaces, such as to increase the effective thickness of the walls and increase their ability to space the article from external packaging and from external forces and impacts; the improvement in which said pattern of grooves defined in each inner wall is separated from said convergence by a primary land portion on each inner wall which extends substantially continuously between the convergence and the pattern of grooves, which pattern includes a primary groove extending straight and substantially parallel to an edge of the wall remote from the convergence, continuously across the full width of the wall, the groove being formed within a ridge extending straight across the full width of the external surface of the wall, and those areas of the external surface of the walls of the protector between said last named ridge and the edges of the walls remote from the convergence defining a plurality of separate quadrilateral depressions corresponding to separate quadrilateral secondary land portions on the inner surface of the walls.

2. A protector according to claim 1, having two perpendicular walls to protect a rectangular edge of an article, wherein the convergence is on a line extending along the channel between two perpendicular walls of the protector, and wherein the primary land portion extends between the channel and the primary groove.

3. A protector according to claim 1, having three perpendicular walls to protect the corner of an article, wherein the convergence is at a point within a cavity defined at a junction of the channels between the walls, and the primary land portion extends between the primary groove and the junction of the channels.

* * * * *